US007213950B1

(12) United States Patent
Lawrence

(10) Patent No.: US 7,213,950 B1
(45) Date of Patent: May 8, 2007

(54) DETACHABLE LIGHT SHADE FOR WALL FIXTURE LIGHTING

(76) Inventor: Linda Kay Lawrence, 1888 Emerald Bay, Rockwall, TX (US) 75087

( * ) Notice: Subject to any disclaimer, the term of this patent is extended or adjusted under 35 U.S.C. 154(b) by 159 days.

(21) Appl. No.: 11/029,120

(22) Filed: Jan. 3, 2005

Related U.S. Application Data

(60) Provisional application No. 60/535,096, filed on Jan. 9, 2004.

(51) Int. Cl.
*F21V 1/14* (2006.01)
*F21V 17/06* (2006.01)
*F21S 13/02* (2006.01)

(52) U.S. Cl. ..... 362/358; 362/432; 362/439

(58) Field of Classification Search ..... 362/147, 362/358, 368, 432, 433, 437, 439
See application file for complete search history.

(56) References Cited

U.S. PATENT DOCUMENTS 1,877,552 A * 9/1932 Burke ..... 362/433
2,197,946 A * 4/1940 Simpson ..... 362/640
2,516,866 A * 8/1950 Halpern ..... 362/388
2,640,913 A * 6/1953 Little ..... 362/307
2,819,386 A * 1/1958 Linderoth ..... 362/358
3,943,353 A 3/1976 Tada
5,128,850 A 7/1992 Juodvalkis
5,381,320 A * 1/1995 Jordan ..... 362/147
5,577,830 A * 11/1996 Barry et al. ..... 362/152
6,224,239 B1 5/2001 Adler
6,302,566 B1 10/2001 Cohon
6,394,624 B1 5/2002 Hsu
6,663,259 B2 12/2003 Westfall
7,029,143 B2 * 4/2006 Kiechle et al. ..... 362/147

* cited by examiner

*Primary Examiner*—Alan Cariaso
(74) *Attorney, Agent, or Firm*—Ariel S. Bentolila; Bay Area IP, LLC

(57) ABSTRACT

A wire frame means for structurally supporting a light shading material is provided, wherein the light shading material is joined onto a least one side of the structural supporting means that is not a top or bottom side thereof. Means, such as mounting tabs, are further provided for removably joining the structural supporting means to the wall mounted light fixture.

9 Claims, 3 Drawing Sheets

DETACHABLE LIGHT SHADE FOR WALL FIXTURE LIGHTING

CROSS-REFERENCE TO RELATED APPLICATIONS

The present Utility patent application claims priority to provisional application for U.S. Pat. No. 60/535,096 filed on Jan. 9, 2004.

FIELD OF THE INVENTION

The present invention relates generally to lighting fixtures. More particularly, the invention relates to decorative light shade frames designed to detachably fit over a wall mounted light fixture.

BACKGROUND OF THE INVENTION

There have been many attempts to achieve convenient, aesthetically appealing light shades for wall mounted light fixtures that alter light illumination in desired ways, such as diffusing the glare of the light bulbs. However, known approaches have proven to be less than convenient in many application. For example, most conventional approaches require the inconvenient assembly of multiple pieces, or use of hardware, for covering the light or bulbs. Moreover, conventional approaches tend not to allow easy access to change light bulbs without making inconvenient adjustments to the covered frame. Conventional approaches also often attach to the mounted light fixture by attachment means such as clasp, clamps, or magnets, thereby resulting in opportunities to scratch or damage visible surfaces of the light fixture.

In view of the foregoing, there is a need for improved light shading techniques for wall mounted light fixtures. It would be desirable if the light shade was cost effective to manufacture and did not require any substantial assembly thereof by the end user. It would be further desirable if it were also convenient to change light bulbs in the fixture without having to adjust the light shade.

BRIEF DESCRIPTION OF THE DRAWINGS

The present invention is illustrated by way of example, and not by way of limitation, in the figures of the accompanying drawings and in which like reference numerals refer to similar elements and in which.

Unless otherwise indicated illustrations in the figures are not necessarily drawn to scale.

SUMMARY OF THE INVENTION

To achieve the forgoing and other objects and in accordance with the purpose of the invention, a variety of techniques to make detachable light shades for wall fixture lighting are described.

In one embodiment, a wire frame means for structurally supporting a light shading material is provided, wherein the light shading material is joined onto a least one side of the structural supporting means that is not a top or bottom side thereof. Means, such as mounting tabs, are further provided for removably joining the structural supporting means to the wall mounted light fixture or in proximity thereof.

An aspect of the present invention is to provide a decorative light shade for a light fixture enhancement that softens direct glare from exposed light bulbs and requires minimal installation time and effort.

Another aspect of the present invention to provide for the relatively easy changing of light bulbs without requiring the removal or adjustment of the present light shade. In some embodiments of the present invention, this is achieved by providing a frame design that has an open top and bottom on the frame design, which leaves a large enough area to relatively easily access and change light bulbs.

Yet another aspect of the present invention to provide a relatively safe means of attachment to the light fixture. In some embodiments, this is accomplished by way of a tab that is flanked between the wall and mounted light, instead of attaching directly onto the light fixture or bulb itself.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments.

Figure 1:
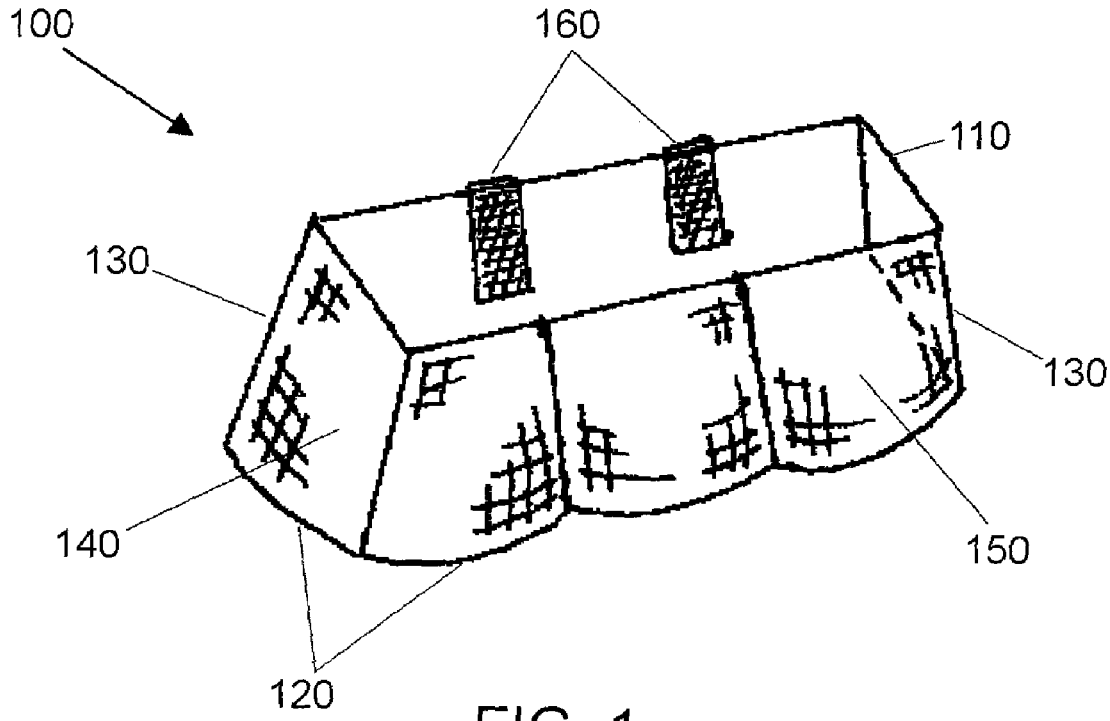
FIG. 1 illustrates a top, frontward perspective view of a light fixture shade according to an embodiment of the present invention.

FIG. 1 illustrates a top, frontward perspective view of a light fixture shade 100 according to an embodiment of the present invention. The exemplary wire frame shown in is shaped into a generally rectangular top rim 110 that is fixedly attached by known means (e.g., welding, gluing, fasteners, etc.) to a three-sided bottom rim 120 by way of wire struts 130, thereby forming light shade side panel areas 140 and a light shade front panel area 150. The formed panel areas 140 and 150 are covered by known light shading materials as illustrated representatively by the hatched textures therein. A back wall mounting side, opposite the front panel area, is left open. Those skilled in the art will readily recognize a multiplicity of alternative frame styles and sizes, which may be achieved by the simple bending and welding of frame wire according to the needs of the particular application. In some embodiments, not all of the front, left, or right sides of the present light fixture shade are covered with light shading material.

The light shading material may be configured onto the present wire frame in any suitable way known to those skilled in the art. In the embodiment shown, the light shading material is stretched tightly over the frame and then fixed onto the frame by known attachment means such as sewing, Velcro, gluing, etc. Those skilled in the art will recognize the proper selection of the light shading material to achieve a desired lighting effect. For example, to alter illumination from the light, various materials that qualify with weight, sheerness, and heat resistance may be used to cover the frame. One suitable light shading material is fabric. Other options include, but are not limited to, cloth, beads, metal mesh, parchment, and plastics. In some embodiments, when sewing fabric onto the frame, tape or fabric strips are used to first wrap the coated wire. Alternative embodiments use tape or trim and cording to additionally enhance the covers finished look.

To enable the mounting of light fixture shade 100 onto a wall mounted lighting fixture, light fixture mounting tabs 160 are movably attached onto the back wall mounting side of top rim 110.

Figure 2:
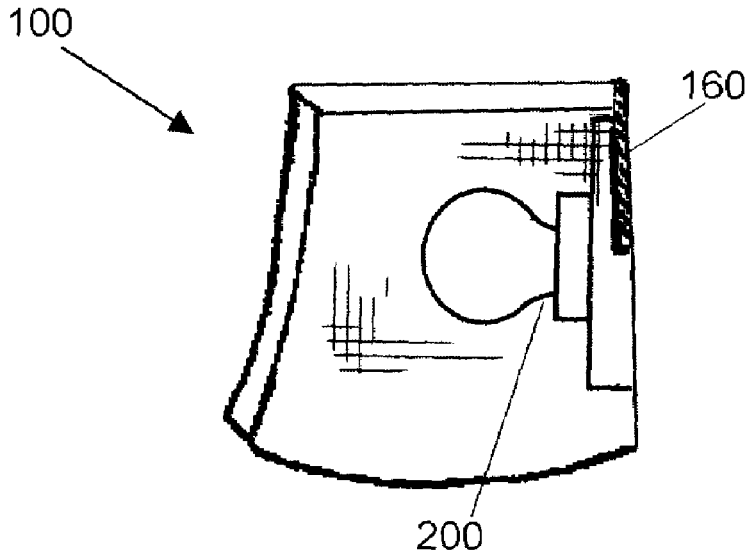
FIG. 2 illustrates a left side, transparent view of the embodiment of FIG. 1 mounted onto a representative wall lighting fixture.

FIG. 2 illustrates a left side, transparent view of the embodiment of FIG. 1 mounted onto a representative wall lighting fixture 200 (e.g., a bathroom bar light, etc.), wherein the right side view is identical to the left view shown. To mount light fixture shade 100 onto wall lighting fixture 200, mounting tabs 160 are slid between the wall and the top of the mounted light fixture to hold the frame on the mounted light. In the Figure, wall lighting fixture 200 is shown as a transparent cross-section to show by way of example, and not limitation, how mounting tabs 160 are lodged into a recess between the wall and the top, wall side of wall lighting fixture 200. Mounting tabs 160 are preferably very thin, and have smoothed edges to protect against causing scratches or otherwise harming the light fixture or wall. The wire frame may be made in a multiplicity of styles and sizes. Preferably, the wire frame design provides a safe/robust distance between the light shading material and the light bulbs of wall lighting fixture 200.

Figure 3:
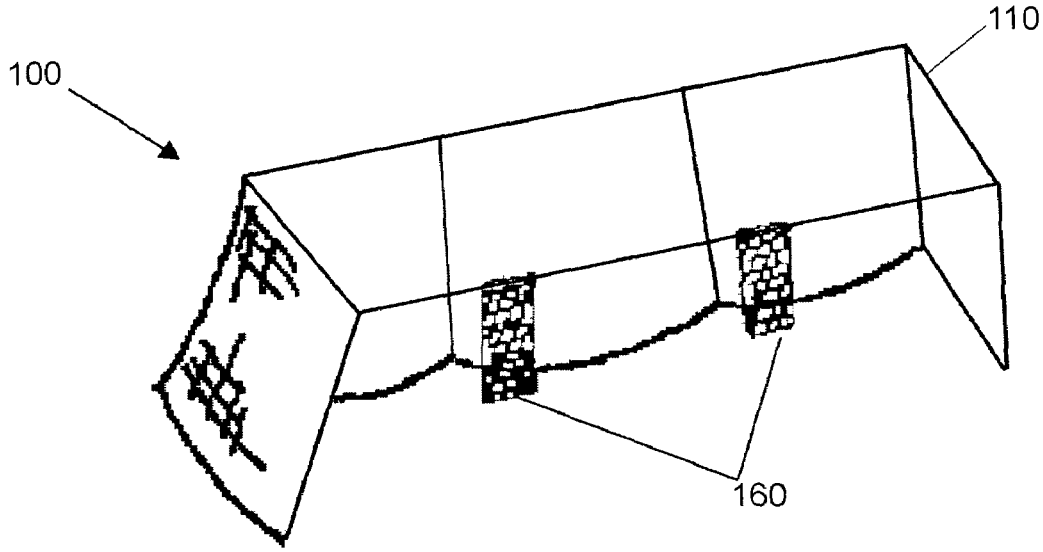
FIG. 3 illustrates a rear perspective view of the embodiment of FIG. 1.
Figure 4:
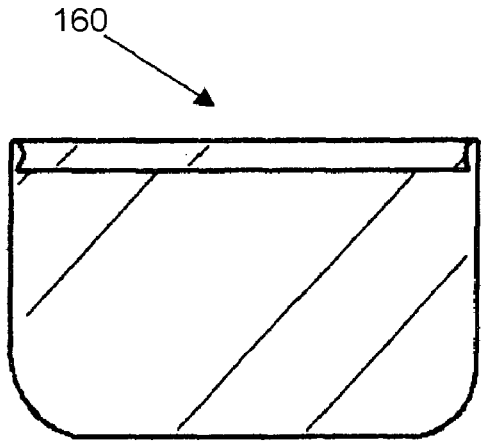
FIG. 4 illustrates a front view of a mounting tab in accordance with an embodiment of the present invention, where
Figure 4A:
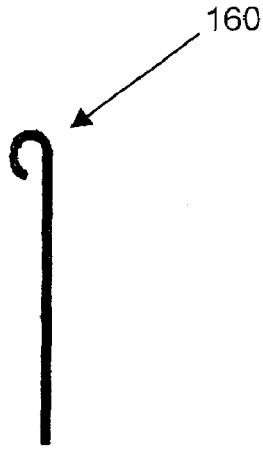
FIG. 4*a* illustrates a right side view thereof, the right side being identical to the left (not shown)

FIG. 3 illustrates a rear perspective view of the embodiment of FIG. 1 showing mounting tabs 160 movably attached to the rear wire of top rim 110. FIG. 4 illustrates a front view of a mounting tab in accordance with an embodiment of the present invention, where FIG. 4*a* illustrates a right side view thereof, the right side being identical to the left, which is not shown. As shown in the Figures, there is a curl at the top of mounting tab 160 that is shaped to wrap around the rear wire of top rim 110. Mounting tabs 160 are preferably movably attached to the rear of top rim 110 such that they may be slid along and rotated about the rear wire of top rim 110; thus permitting mounting tabs 160 to be adjusted to mate into a slot-like fit with a slot receiving location that is typically formed between the mounted light fixture and the wall it is fixed upon. However, some alternative embodiments may fix the mounting tabs onto the wire frame such that they are immovable and are, moreover, sized to mate into certain predefined mounting slots associated with the light fixture. The preferred mounting tab is appropriately sized such that it does not interfere with screws used to fix the light fixture to the wall, thereby enhancing the ease of using the shade. Depending on the needs of the particular application, those skilled in the art will recognize a multiplicity of alternative and suitable embodiments for the mounting tabs and the attachment thereof. The mounting tabs may be added during or after manufacturing of the wire frame. Suitable means of attaching the mounting tabs to the back of the top rim includes, but is not limited to, being welded on, pressed on, wrapped or curled around the wire, or any combinations of these techniques. Moreover, the mounting tabs may be replaced by any known and suitable attachment means including, but not limited to, small rods, pin type items, or straps.

One aspect of the embodiment shown in FIGS. 1–3 is that the bottom and top of light fixture shade 100 is open, which not only directs light illumination, but also provides relatively easy access to the light fixture when light bulbs require replacement.

In an exemplary implementation of light fixture shade 100, the wire frame is made of C-1008 cold drawn steel and the mounting tabs are made of 0.025 gauge thin aluminum that is curled at the top around the rear wire of top rim 110. Dependent on the particular design choice and light fixture to be covered, mounting tabs 160 typically may sized from widths of ¼ inch to 36 inches and lengths of ¾ inch to 5 inches. Mounting tabs 160 may be made of any suitable material, including, but not limited to, steel, copper, brass, aluminum, and plastic. In some embodiments, some, or all, metal components of the present light fixture shade (e.g., the wire frame and the mounting tabs) are coated, finished, on their exterior by known means to prevent or retard rust or types of corrosion or to provide a desired aesthetic appearance. One common finishing technique is zinc plating or powder coatings.

One process to make a light fixture shade according to the principles of the present invention is to start with shaping, welding, grinding and coating wire to desired wire frame form. Typically, the wire frame is formed to cover the length, width, and dept of the light fixture that the present light fixture shade is to be attached to. The wire frame may be covered by sewing onto, otherwise adhering, light shading materials onto the wire frame that diffuse light from the light fixture and are, preferably, resistant to heat radiated from the light bulbs. Suitable light shading materials, include, but are not limited to: fabrics, cloth, papers, skins, plastics, and beads. Dependent on what procedure is optimal, the mounting tabs may be added before or after covering the frame. Of course, any welding should be done before adding the light shading material. The mounting tabs are then, either bent to wrap the rear wire of the top rim, directly welded, or used in combination, otherwise, fixed/movably adhered thereon.

Figure 5:
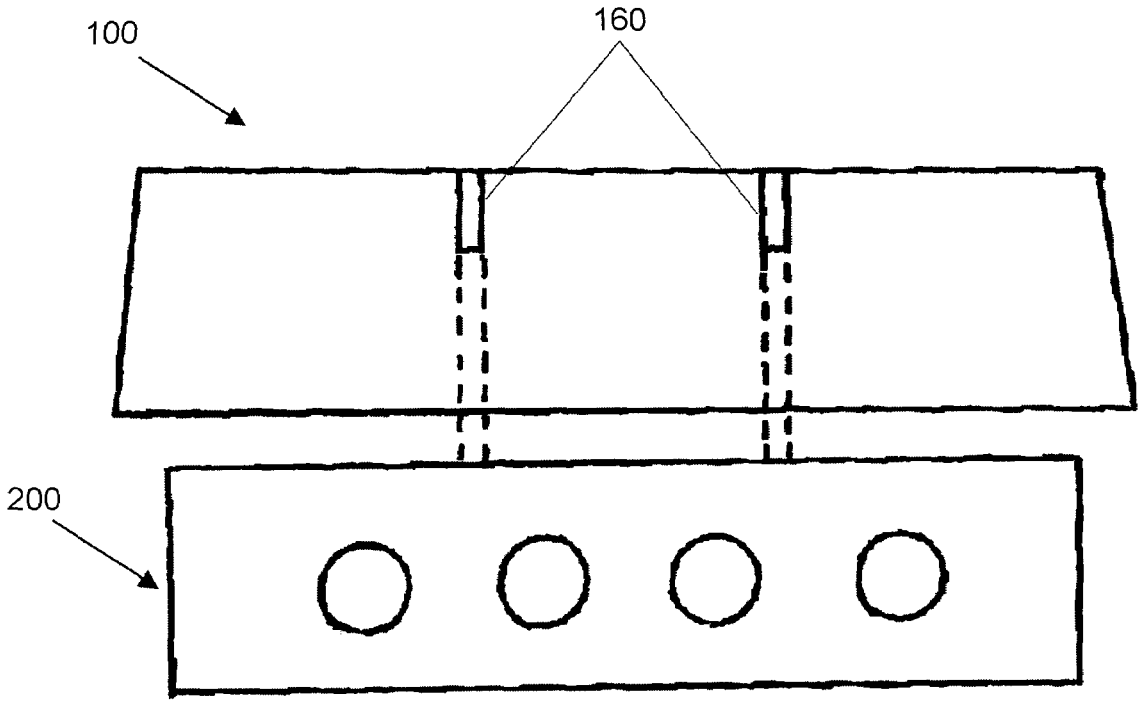
FIG. 5 illustrates a front view of the embodiment of FIG. 1 in the process of being mounted onto the representative wall lighting fixture of FIG. 2.

FIG. 5 illustrates a front view of the embodiment of FIG. 1 in the process of being mounted onto the representative wall lighting fixture of FIG. 2, wherein the dashed lines show the alignment of mounting tabs 160 as light fixture shade 100 is descended upon wall lighting fixture 200 where mounting tabs 160 will be lodged into a typically preexisting receiving slot in the back of lighting fixture 200.

Referring again to FIGS. 1–3, although two mounting tabs 160 are shown in the Figures, alternative embodiments (not shown) may have any number, but at least one, of mounting tabs depending on the needs of the particular application.

Some embodiments (not shown) may not include three-sided bottom rim 120, whereby wire struts 130 and the light shading material itself are designed to provide and adequate degree of structural support. Moreover, yet other embodiments (not shown) that do include three-sided bottom rim 120, but are further provided with a structural support wire bridging the wall side of bottom rim 120 (thereby making a four sided bottom rim) such that mounting tabs 160 may be attached thereon in a similar manner as described for movably attached them to the rear wire of top rim 110, thereby providing a mounting means from below the light fixture in addition to or in place of the top rim mounting means shown in the Figures. Similarly, alternative embodiments (not shown) exist that, in addition to or in place of the top rim mounting means shown in the Figures, attach mounting tabs 160 to the vertical wires of the wire frame that rest on the wall in a similar manner as described for movably attached them to the rear wire of top rim 110, thereby providing a mounting means to the left and right sides light fixture.

Having fully described at least one embodiment of the present invention, other equivalent or alternative methods of providing detachable light shades for wall fixture lighting according to the present invention will be apparent to those skilled in the art. The invention has been described above by way of illustration, and the specific embodiments disclosed are not intended to limit the invention to the particular forms disclosed. The described embodiments in the foregoing were directed to implementations that covered the entire lighting fixture; however, similar techniques may be readily adapted to, instead, provide individual shading for each light bulb thereof rather than one shade frame that covers entire light fixture. Thus, such light bulb shading implementations of the present invention are contemplated as within the scope of the present invention. The invention is thus to cover all modifications, equivalents, and alternatives falling within the spirit and scope of the following claims.

What is claimed is:

1. A detachable light shade apparatus for a wall mounted light fixture, the apparatus comprising:

a wire frame having a top rim, a bottom rim, formed panel areas, and an open back wall mounting side;

a light shading material joined onto at least one of said formed panel areas; and at least one mounting tab joined to a wire of said back wall mounting side of said wire frame, said mounting tab being configured to slide along and rotate about said wire and to removably hold on to a backside portion of the wall mounted light fixture.

2. The detachable light shade apparatus of claim 1, wherein said at least one mounting tab is joined to a top wire of said back wall mounting side of said wire frame.

3. The detachable light shade apparatus of claim 1, wherein said wire frame is made of cold drawn steel.

4. The detachable light shade apparatus of claim 1, wherein the light shading material is made of a fabric, cloth, papers, skin, plastic, or beads.

5. The detachable light shade apparatus of claim 1, wherein said at least one mounting tab is made of steel, copper, brass, aluminum, or plastic.

6. The detachable light shade apparatus of claim 1, wherein said at least one mounting tab is rigid and flat.

7. The detachable light shade apparatus of claim 1, wherein said at least one mounting tab is a small rod, a pin, or a strap.

8. The detachable light shade apparatus of claim 1, wherein top and bottom sides of said wire frame are not covered by any material.

9. A detachable light shade apparatus for a wall mounted light fixture, the apparatus comprising:

means for structurally supporting a light shading material, the light shading material being joined onto at least one side of said structural supporting means that is not a top or bottom side thereof;

means for joining the light shading material to said structural supporting means; and means for removably joining said structural supporting means to the wall mounted light fixture or in proximity thereof, said joining means configured to slide along and rotate about a back side of said structural supporting means.

* * * * *